US006074553A

United States Patent [19]

Haski

[11] Patent Number: 6,074,553

[45] Date of Patent: Jun. 13, 2000

[54] WATER SKIMMER

[76] Inventor: Robert Haski, 114 Hopetoun Avenue, Vaucluse, N.S.W. 2030, Australia

[21] Appl. No.: 09/248,332

[22] Filed: Feb. 10, 1999

[30] Foreign Application Priority Data

Feb. 11, 1998 [AU] Australia ..... 53893/98

[51] Int. Cl.[7] ..... E04H 3/16; C02F 1/40

[52] U.S. Cl. ..... 210/169; 210/170; 210/242.1; 210/242.3; 210/416.2

[58] Field of Search ..... 210/91, 169, 206, 210/242.1, 242.3, 923, 170, 416.2; 4/490; 15/1.7

[56] References Cited

U.S. PATENT DOCUMENTS 3,753,265 8/1973 Wulc .
3,767,055 10/1973 Flatland .
3,928,202 12/1975 Raubenheimer .
4,105,557 8/1978 Weatherholt .
4,305,830 12/1981 Shimura .
4,348,192 9/1982 Pansini .
4,746,424 5/1988 Drew .
4,839,063 6/1989 Brooks .
4,900,432 2/1990 Arnold et al. ..... 210/91
5,106,492 4/1992 Distinti et al. ..... 210/91
5,128,031 7/1992 Midkiff .
5,238,585 8/1993 Reed, Sr. .
5,788,850 8/1998 Tuomey .
5,919,359 7/1999 Bisseker .

*Primary Examiner*—David A. Simmons
*Assistant Examiner*—Fred Prince
*Attorney, Agent, or Firm*—Baker & Daniels

[57] ABSTRACT

Disclosed is a water skimmer which floats on the surface of a body of water. The skimmer is propelled by an on-board propulsion unit, and collects and traps floating debris along its movement path. A guide mechanism is provided to sense the presence of obstacles in the path of the skimmer. The guide mechanism acts on a thrust vectoring means in response to a detected obstacle to change the direction of motion of the skimmer.

3 Claims, 1 Drawing Sheet

WATER SKIMMER

TECHNICAL FIELD

The present invention relates to water skimmers used in removing floating debris from the surface of a body of water. The present invention is described in the context of a swimming pool skimmer, but is equally applicable to cleaning larger areas such as lakes and harbours.

BACKGROUND ART

There are often occasions where a body of water becomes polluted by the presence of floating debris, whether it be an oil or toxic waste spill in the open sea, or leaves in a swimming pool.

Owning a pool involves a great deal of maintenance, from maintaining the quality of the water to regularly removing debris such as leaves, dead insects and other pollutants. If left unattended, floating debris such as these will eventually sink to the bottom of the pool, making the task of cleaning more difficult.

Devices exist to relieve the pool owner from the burden of some of these mundane tasks. Some devices travel underwater over the walls and floor of the pool, removing scum from the surface of the walls and floor, while other devices float on the water and skim the surface to remove floating debris.

Some of these devices, although reducing the workload of the pool owner, must still be supervised, as their path of movement is easily blocked by obstacles such as other cleaning devices, floating pool accessories, and the pool walls. A number of solutions have been proposed to enable skimmers to avoid obstacles without requiring constant supervision.

U.S. Pat. No. 5,106,492 (Distinti et. al.) discloses a swimming pool skimmer having a deflection assembly comprising an arm extending in front of the skimmer. The arm is made of a resiliently flexible material, which pushes the skimmer away from any obstacle upon forced contact.

U.S. Pat. No. 4,900,432 (Arnold et. al.) discloses a swimming pool skimmer which has an electrical sensor which actuates a second motor when the sensor detects an obstacle. The thrust direction of the second motor is arranged at an angle to that of the main propulsion unit so as to change the main direction of motion of the skimmer and direct it away from the obstacle. This obviously requires additional control circuitry and additional power for the second motor, making the device complex and expensive.

In both of these prior art devices, a debris collection cavity is created within the buoyancy body of the skimmer, and debris is collected as the skimmer moves over the surface of the water by way of an impeller which also aids in scooping the debris into the catchment cavity. This arrangement has a number of disadvantages.

Firstly, with the catchment cavity disposed within the body of the skimmer, the amount of debris that can be collected is limited by the size of the body of the skimmer. A further drawback is that the impeller is arranged to make direct contact with the debris, that is, the impeller is located at the entrance to the catchment cavity, and is therefore susceptible to becoming jammed by debris.

SUMMARY OF THE INVENTION

It would be advantageous if the present invention could provide a useful alternative to existing devices, bearing in mind the drawbacks present in the above prior art devices.

Accordingly, the invention provides a water skimmer which has a buoyant hollow body having a duct extending through the body from a catchment opening at a front end to a discharge opening at a rear end of the body. The skimmer is propelled by way of a propulsion unit supported at a lower portion of the body. A debris catchment member is attached externally at the rear end of the body in extension of the discharge opening to catch debris floating on the surface of the water passing through the duct. There is also provided a guide mechanism arranged to sense the presence of objects in the movement path of the skimmer and to act upon a thrust vectoring mechanism of the propulsion unit to change the path of movement of the skimmer.

Because the debris catchment member is disposed externally to the body of the skimmer, the body itself can be made smaller, thereby lowering manufacturing costs. The location of the propulsion unit below the waterline of the body away from the debris catchment zone ensures that debris will not jam the propulsion unit during the collection operation.

Preferably, the guide mechanism includes at least one arm which is supported at the body of the skimmer and which protrudes in a forward direction from the front end. The at least one arm is operationally connected to the thrust vectoring mechanism, so that any displacement of the arm due to contact with an obstacle is translated into a displacement of the thrust vectoring means which modifies the direction of thrust, thereby changing the movement path of the skimmer. In a more preferred form, the guide mechanism will include two arms, one on either side of the body, each arm being connected to the thrust vectoring mechanism of the propulsion unit.

Preferably, the thrust vectoring means includes at least one rudder element which is disposed to be actuated by the guide mechanism. Alternatively, the propulsion unit is supported in a housing which is rotatably mounted at the skimmer body about a vertical axis, the guide mechanism being arranged to selectively rotate the housing to change the direction of thrust of the propulsion unit.

The power source may optionally be an onboard battery, or an array of solar power cells connected either directly to the propulsion unit, or via an intermediate rechargeable battery to the propulsion unit.

In a preferred form, the debris catchment member will comprise a net which trails behind the skimmer, trapping debris channelled through the duct.

The skimmer may be of any size, the size being determined by its particular application. Larger skimmers according to the present invention could be used on lakes or other waterways to clear the area of debris or spilt oil, in which case the catchment member could be a muslin-like cloth.

The guidance mechanism of the present invention does not require complex circuitry or additional propulsion units, and thus allows the skimmer to operate effectively without supervision.

Preferred embodiments of the present invention will be described below with reference to the accompanying Figures.

DESCRIPTION OF PREFERRED EMBODIMENTS

Figure 1:
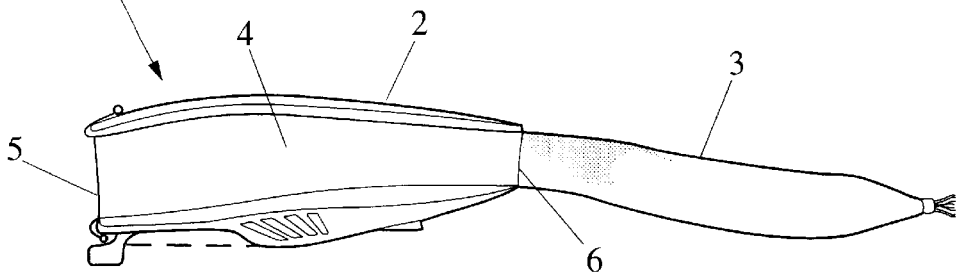
FIG. 1 shows a schematic, longitudinal section of a preferred skimmer according to the present invention.

In FIG. 1, body 2 of skimmer 1 is shown with duct 4 and trailing net 3. Body 2 may be made from suitable materials such as sandwiched polystyrene, or a plastic material which will provide a strong but buoyant body.

In use, the lower edge of duct 4 will be below the surface of the water, while the upper edge of duct 4 will be above the surface of the water. As the skimmer moves across the surface of the pool, water enters opening 5 of duct 4, passes through duct 4 and exits the duct through opening 6 at the rear end of the body. Any debris floating on the surface of the water passing through the duct is trapped in net 3. Preferably, there will be a floating boom (not shown) at the opening 5 to prevent trapped debris from exiting duct 4 if the skimmer stops or reverses.

Figure 2:
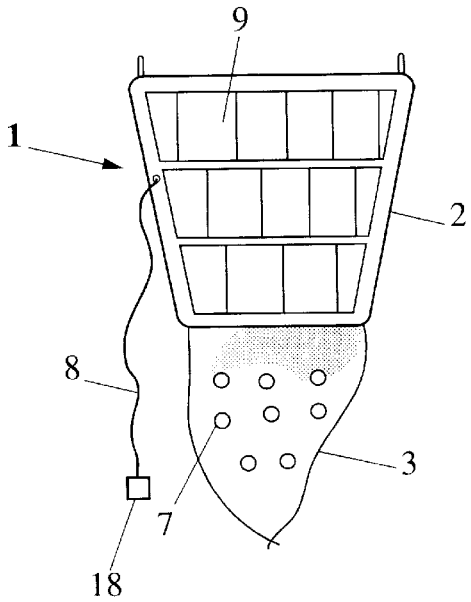
FIG. 2 shows a top view of the skimmer of FIG. 1.

Net 3 is located outside body 2 of the skimmer, so that the capacity of the catchment area is not limited by the size of the body. Net 3 may comprise netting of variable mesh and size to accommodate the particular application, whether it be the collection of wood, bottles, leaves, insects, dust or oil. Net 3 may equally be replaced by a rigid cage. A further advantage of this particular arrangement is that cleaning of the skimmer 1 of debris is very easy. All that is required is removal of the net from body 2 and emptying of the net. Optionally, small styrofoam beads 7 or the like may be attached to net 3 to make it more buoyant. These beads are shown in FIG. 2. The buoyancy of the net facilitates the transfer of debris from duct 4 into the net.

In FIG. 2, there is shown the preferred form of power supply for the skimmer 1. Disposed on the top surface of body 2 is an array of solar cells 9. These allow the skimmer to be powered cheaply and in an environmentally friendly manner and will allow the skimmer to operate continuously throughout the day. In a preferred form, the skimmer will also have at least one rechargeable battery 11 (FIG. 3) on board, which is charged by the solar cells and delivers a source of constant power to the propulsion unit which is described below. This also allows the skimmer to operate when there is no sunlight available, until the battery itself is discharged. The positioning of the batteries at the lower, submerged part of body 2 provides stabilising ballast. Alternatively, skimmer 1 may be powered purely by an onboard battery, whether rechargeable or not Optionally, there is also a string or cord 8 attached at one end to body 2 and at the other end to a floating bob 18 to facilitate retrieval of the skimmer.

Figure 3:
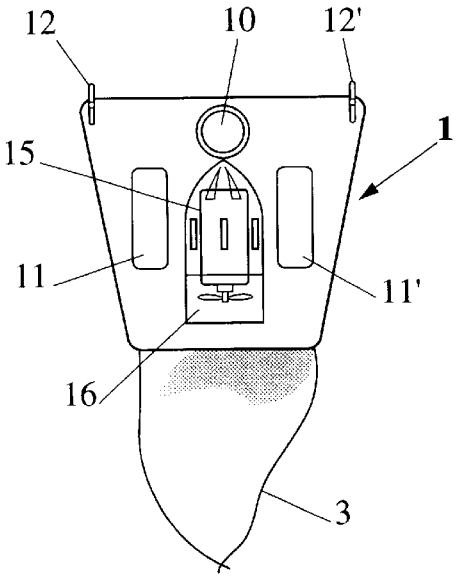
FIG. 3 shows a bottom view of the skimmer of FIG. 1.
Figure 4:
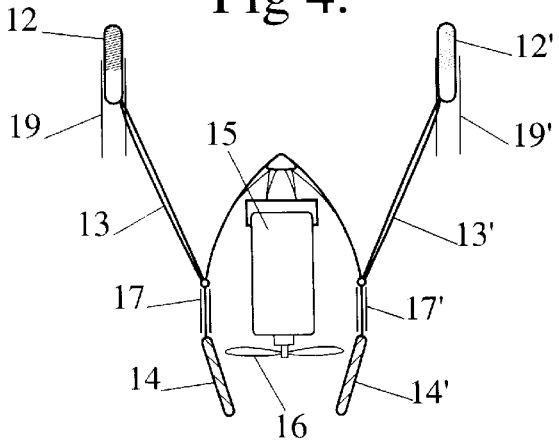
FIG. 4 illustrate schematically the guiding mechanism and thrust vectoring means of the skimmer, including thruster probes, thrust deflectors and the propulsion unit.

Propulsion unit 15 is shown in FIGS. 3 and 4. It consists of an electric motor driving a propeller 16. The electric motor is mounted in a watertight housing on the underside of the skimmer, thus providing additional stabilising ballast to the craft. Propeller 16 is shrouded to prevent possible injury or damage to people or objects present in the pool while the skimmer is active.

Also shown in FIG. 3 is an optional housing 10 for chlorine tablets or other substances commonly used for the maintenance of pools.

Probes 12, 12' form part of the guidance mechanism, which is shown in more detail in FIG. 4. In this particular embodiment, probes 12, 12' are each disposed between two guide rails 19, 19' which are mounted integrally or moulded onto the underside of body 2 near the front face. These probes are able to slide back and forth between the guides. One end of each probe is coupled to a rod 13, 13' which is slidably mounted to the housing of the propulsion unit 15. At the other end of rod 13, 13' there is coupled a rudder element 14, 14'. The sliding displacement of rod 13, 13' is converted into a rotational displacement of rudder element 14, 14'. This change in position of rudder element 14, 14' will modify the direction of thrust generated by propulsion unit 15, in turn changing the direction of travel of the skimmer.

For example, if an obstacle strikes probe 12', the probe will be forced to slide backwards between guide rails 19'. This displacement is transferred to rod 13' to cause the other end of rod 13', which is mounted between similar guide rails 17' on the housing of the propulsion unit 15, to be similarly displaced in a backwards direction.

This end of rod 13' is coupled to rudder element 14' in such a way as to convert the linear displacement of rod 13' into a rotational displacement of rudder element 14'. In this case, rudder element will be rotated inwards, toward the propulsion unit 15, thereby biasing the direction of thrust to the left as viewed from the perspective of FIG. 4. This in turn will cause the skimmer to veer to the left and away from the obstacle at probe 12'. Rod 13' or rudder element 14' are biased (not shown) so as to return to a neutral position when the obstacle is no longer forcing on the probe 12'. This will allow the rudder element 14' to return to a neutral position, allowing the skimmer, in its normal mode of operation, to proceed in a straight path. Rudder elements 14 and 14' could alternatively be replaced by a single rudder element positioned directly in the path of thrust.

Another possible embodiment is to have the propulsion unit 15 pivotally mounted and arranged so that a deflection of rod 13' will cause the propulsion unit 15 to be rotated, thereby providing the change in direction of thrust, and thus the change in direction of the motion of the skimmer.

It will be understood that further variations of the above described skimmer are possible within the scope of the invention. For example, an electronic control logic can be incorporated into the skimmer, whereby the skimmer may be programmed to follow a predetermined course or path. Heretofore, actuators operatively connected with the control logic can be used to act on the guide mechanism's rudder(s) in response to direction commands provided by the control logic.

The claims defining the invention are as follows:

1. A water skimmer, including:

a buoyant hollow body having a front end, a rear end, a bottom part and a top surface and having a duct extending from an opening at the front end of the body through to an opening at the rear end of the body;

a propulsion unit supported at the bottom part of the body so as to propel the skimmer along a movement path;

an onboard power plant for supplying power to the propulsion unit;

a thrust vectoring means arranged to change the path of movement of the skimmer;

a debris catchment member mounted at the rear end of the body and disposed externally of the body to receive water and debris entering the body, passing through the duct and exiting the rear end opening; and a guide mechanism arranged to sense an obstacle in the movement path of the skimmer and, in response to sensing such obstacle to act on the thrust vectoring means to effect said change in the movement path.

2. A water skimmer according to claim 1, wherein the guide mechanism includes at least one contact probe, extending away from the body, the probe being operationally connected to said thrust vectoring means to effect said change of movement path.

3. A water skimmer according to claim 2, wherein the guide mechanism includes two probes disposed one on either widthwise side at the front end of the body, both probes being connected to said thrust vectoring means by means of respective coupling rods.

* * * * *